US012320141B2

(12) United States Patent
Vadas

(10) Patent No.: US 12,320,141 B2
(45) Date of Patent: Jun. 3, 2025

(54) TEMPORARY BARRIER FENCING

(71) Applicant: NO THRU IP PTY LTD, Newcastle (AU)

(72) Inventor: James Vadas, Newcastle (AU)

(73) Assignee: NO THRU IP PTY LTD, Newcastle (AU)

( * ) Notice: Subject to any disclaimer, the term of this patent is extended or adjusted under 35 U.S.C. 154(b) by 415 days.

(21) Appl. No.: 18/000,267

(22) PCT Filed: Jun. 3, 2021

(86) PCT No.: PCT/AU2021/050550
§ 371 (c)(1),
(2) Date: Nov. 29, 2022

(87) PCT Pub. No.: WO2021/243411
PCT Pub. Date: Dec. 9, 2021

(65) Prior Publication Data

US 2023/0203835 A1 Jun. 29, 2023

(30) Foreign Application Priority Data

Jun. 3, 2020 (AU) ..... 2020901816
Jul. 10, 2020 (AU) ..... 2020902381
(Continued)

(51) Int. Cl.
*E04H 17/18* (2006.01)
*E04H 17/16* (2006.01)

(52) U.S. Cl.
CPC ..... *E04H 17/18* (2013.01); *E04H 17/165* (2013.01)

(58) Field of Classification Search
CPC ..... E04H 17/009; E04H 17/14; E04H 17/16; E04H 17/161; E04H 17/163;
(Continued)

(56) References Cited

U.S. PATENT DOCUMENTS 6,554,257 B1 * 4/2003 Kenton ..... E04G 21/3233 256/65.14
6,845,970 B1 1/2005 Kenton
(Continued)

FOREIGN PATENT DOCUMENTS

AU 654255 10/1994
DE 10020988 A1 * 1/2001 ..... E04H 12/2246
(Continued)

OTHER PUBLICATIONS

International Search Report & Written Opinion dated Aug. 23, 2021 from PCT Application No. PCT/AU2021/050550.
(Continued)

*Primary Examiner* — Jonathan P Masinick
(74) *Attorney, Agent, or Firm* — INNOVATION CAPITAL LAW GROUP, LLP; Vic Lin

(57) ABSTRACT

Temporary barrier fencing has at least one fence panel having a bracing post at one end which engages a support foot and which comprises a brace which braces an adjacent post and a locking post at an opposite end which keys the foot depending on the orientation of the panel with respect to the foot thereby being intrinsically secure against forced entry.

29 Claims, 8 Drawing Sheets

(30) Foreign Application Priority Data

Oct. 27, 2020 (AU) ..... 2020903895
Dec. 1, 2020 (AU) ..... 2020904447

(58) Field of Classification Search
CPC ..... E04H 17/165; E04H 17/18; E04H 17/185; E04H 17/22; E04H 12/22; E04H 12/2238; E04H 12/2246; E01F 13/02; E01F 13/022
See application file for complete search history.

(56) References Cited

U.S. PATENT DOCUMENTS

| | | | | |
|---|---|---|---|---|
| 7,338,033 | B2 * | 3/2008 | Anson | E01F 9/692 256/65.01 |
| 7,500,654 | B2 * | 3/2009 | Rosaen | E04H 12/2215 256/65.01 |
| 9,464,452 | B2 * | 10/2016 | Higgs | E04H 12/2238 |
| 9,677,299 | B2 * | 6/2017 | Whiteley | E04H 12/2246 |
| 9,863,162 | B2 * | 1/2018 | Whiteley | E04H 17/16 |
| 10,214,935 | B2 * | 2/2019 | Whiteley | E04H 12/2238 |
| 10,731,373 | B2 * | 8/2020 | Lomax | E04H 12/2238 |
| 11,255,102 | B2 * | 2/2022 | Lomax | A61P 35/00 |
| 2004/0206947 | A1 | 10/2004 | Rosaen | |
| 2007/0170411 | A1 * | 7/2007 | Ribak | E01F 13/022 256/32 |
| 2010/0295007 | A1 * | 11/2010 | Preston | E01F 13/022 256/31 |
| 2014/0145046 | A1 * | 5/2014 | Layne | E04H 12/2269 248/188.1 |
| 2017/0096836 | A1 | 4/2017 | Ritter et al. | |
| 2018/0044867 | A1 * | 2/2018 | Whiteley | E04H 17/18 |

FOREIGN PATENT DOCUMENTS

| | | | | |
|---|---|---|---|---|
| DE | 20208782 | U1 | 8/2002 | |
| EP | 1447477 | A1 | 8/2004 | |
| FR | 2859747 | A1 * | 3/2005 | E01F 9/692 |
| GB | 2198770 | A | 6/1988 | |
| GB | 2363402 | A | 12/2001 | |
| GB | 2437285 | A * | 10/2007 | E01F 13/022 |
| GB | 2442338 | A * | 4/2008 | E04H 17/161 |
| WO | WO-2012000020 | A1 * | 1/2012 | E01F 9/692 |

OTHER PUBLICATIONS

International-type search report dated Oct. 29, 2020 from AU application No. 2020902381.

* cited by examiner

TEMPORARY BARRIER FENCING

FIELD OF THE INVENTION

This invention relates generally to temporary barrier fencing and, more particularly, to temporary barrier fencing which is intrinsically secure against forced entry.

BACKGROUND OF THE INVENTION

GB 2363402 A (WIGLEY VICTOR JOSEPH) 19 Dec. 2001 [hereinafter referred to as D1] discloses a fence which keys into concrete bases to prevent the fence from being lifted from the bases during forced entry.

The present invention seeks to provide temporary barrier fencing, which will overcome or substantially ameliorate at least some of the deficiencies of the prior art, or to at least provide an alternative.

It is to be understood that, if any prior art information is referred to herein, such reference does not constitute an admission that the information forms part of the common general knowledge in the art, in Australia or any other country.

SUMMARY OF THE DISCLOSURE

A problem unrecognised by D1 is that the concrete bases of D1 may be rotated to disconnect the fence thereby necessitating large concrete bases or securement of the concrete bases to the ground.

There is provided herein temporary barrier fencing which is intrinsically secure against forced entry.

The fencing comprises a fence panel comprising a bracing post at one end and a locking post at an opposite end.

The bracing post engages a support foot and comprises a brace which braces an adjacent post. Furthermore, the locking post keys the foot depending on the orientation of the panel with respect to the foot.

The fencing comprises an arrangement of a plurality of these fencing panel supported by a plurality of support feet therebetween wherein each foot is engaged by a bracing post and a locking post of adjacent panels which cooperate together to intrinsically secure the panels to the foot.

The locking post prevents the panels from being lifted from the foot and the brace holds the posts in alignment which prevents the foot from being rotated with the posts.

As such, the present temporary fencing is intrinsically secure without having to use larger support feet or secure the support feet in place.

The present fencing system may further comprise an upper fence panel retainer which prevents upper ends of the posts from being prised apart.

Feet of different configurations are possible within the present embodiments, including block-type feet comprising post apertures into which the posts insert and frame-type feet comprising uprights which insert into the posts.

Aspects are also provided herein relating to a foot which can be stacked in a variety of configurations (including cantilevered configurations) to apply weight depending on requirements.

Yet further aspects are provided herein relating to a foot cover which engages the feet to prevent ballast (such as sandbags) from being removed when the locking post is locked to the foot.

According to one aspect, there is provided a temporary barrier fencing comprising at least one fence panel comprising: a bracing post which engages a support foot and which comprises a brace which braces an adjacent post in use; and a locking post which keys the foot depending on the orientation of the panel with respect to the foot so that the locking post cannot be pulled from the foot The fencing may comprise a plurality of the fencing panels supported by a plurality of support feet therebetween wherein each foot is engaged by a bracing post and a locking post of adjacent panels.

The brace may comprise an aperture through which the locking post inserts and wherein the locking post can rotate within the aperture.

The brace may extend from a horizontal cross bar of the panel.

The foot may comprise a pair of post apertures within which the posts insert.

The brace may comprise an aperture through which the locking post inserts and wherein, when the bracing post is inserted into a first of the pair of post apertures, the aperture of the brace collocates with a second of the pair of post apertures.

A post aperture and the locking post may define a key which slots into a corresponding keyhole depending on the orientation of the panel with respect to the foot.

The key and the keyhole may be aligned at 45° with respect to an orthogonal axis of the foot so that the key inserts into the keyhole when the panel is at 45° with respect to the foot and the locking post locks the foot when being orthogonal with respect to the foot.

The locking post may comprise the key and wherein the aperture may comprise the keyhole and wherein the key extends further than a length of the bracing post.

The foot may comprise a base frame supporting a pair of uprights which insert into open ends of the posts.

Each upright may comprise a key either of which may slot into a keyhole of the locking post depending on the orientation of the panel with respect to the foot.

The post of the locking panel may comprise an upper retainer which prevents the posts from being prised apart when the locking post is locked to the foot.

The retainer may comprise a proximal piece connected to the locking post, the cross piece and an insertion piece, and wherein the insertion piece inserts into the bracing post as the locking post engages the foot.

An upper end of the bracing post may hit the cross piece if the bracing post is lifted whilst the locking post locks the foot.

The insertion piece may have sufficient length so that a distal end thereof remains within the bracing post as the locking post disengages from the foot.

The foot may comprise a plurality of pairs of post apertures therein for engaging the posts adjacently therein at differing positions.

The foot may comprise a shell defining an interior for ballast.

The plurality of the pairs of post apertures may be arranged along a length of the foot so that the foot can engage the posts centrally or at one end thereof.

The pairs of post apertures comprise pairs of apertures comprising keyholes and pairs of apertures devoid of keyholes.

The fencing may further comprise an arrangement of studs extending from a surface thereof and a corresponding arrangement of conforming recesses on an opposite surface thereof.

The studs and recesses may be arranged so that feet can be stacked orthogonally.

The studs and recesses may be noncircular and comprise orthogonal symmetry.

The fencing may further comprise a foot cover which covers the foot, which is shaped to define a ballast void therein and which cannot be removed from the foot when the locking post is locked to the foot.

The cover may be configured to allow the posts to extend therethrough to engage the foot.

The cover may be elongate and engages the posts therethrough at a substantial midpoint of the cover.

The cover may comprise a pair of post apertures for the posts to engage the foot therethrough.

The cover may entirely conceal the foot.

The cover may comprise a saddle thereacross which presses against crossbars of panels engaged to the foot.

According to another aspect, there is provided a method of erecting temporary barrier fencing as described herein comprising engaging a bracing post to the support foot and then connecting a locking post to the support foot in a first orientation and then rotating the locking post to a second orientation such that the brace braces the locking post, and the locking post keys the foot so that the locking post cannot be pulled from the foot.

Other aspects of the invention are also disclosed.

BRIEF DESCRIPTION OF THE DRAWINGS

Notwithstanding any other forms which may fall within the scope of the present invention, preferred embodiments of the disclosure will now be described, by way of example only, with reference to the accompanying drawings in which.

DESCRIPTION OF EMBODIMENTS

Figure 1:
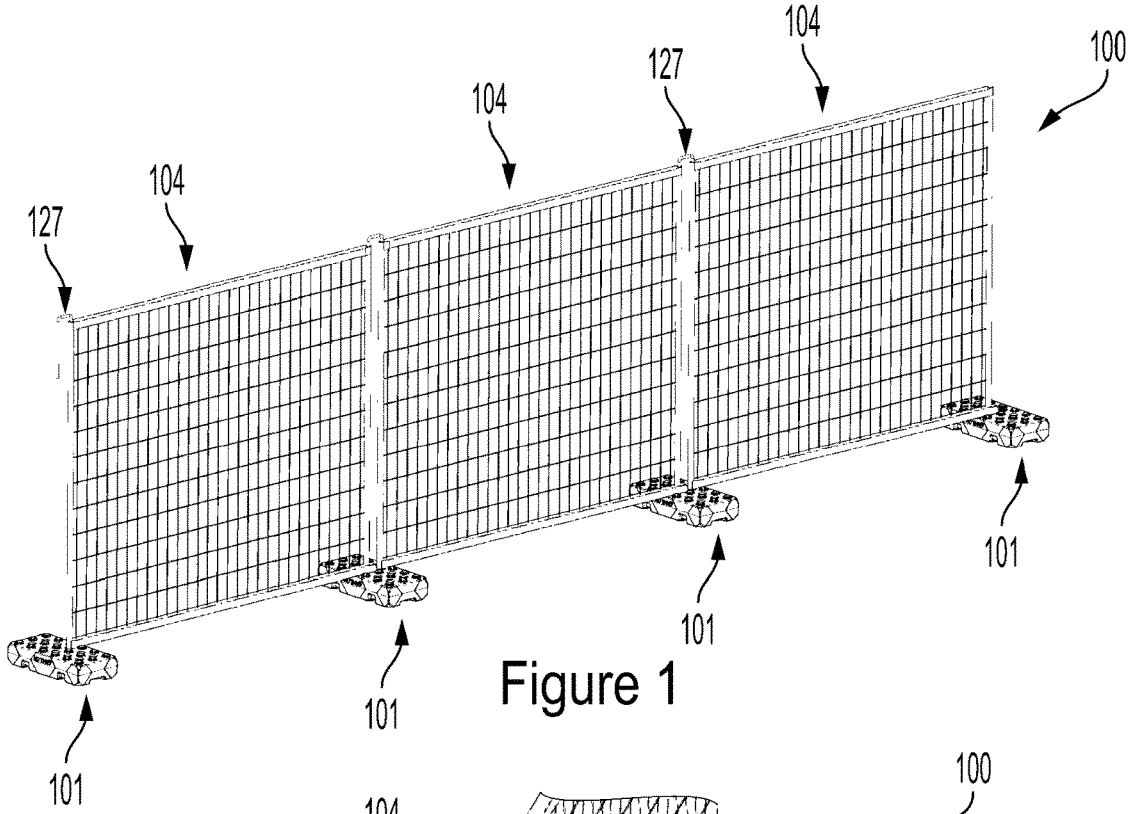
FIGS. 1 and 2 show perspective views of temporary barrier fencing in accordance with an embodiment.
Figure 6:
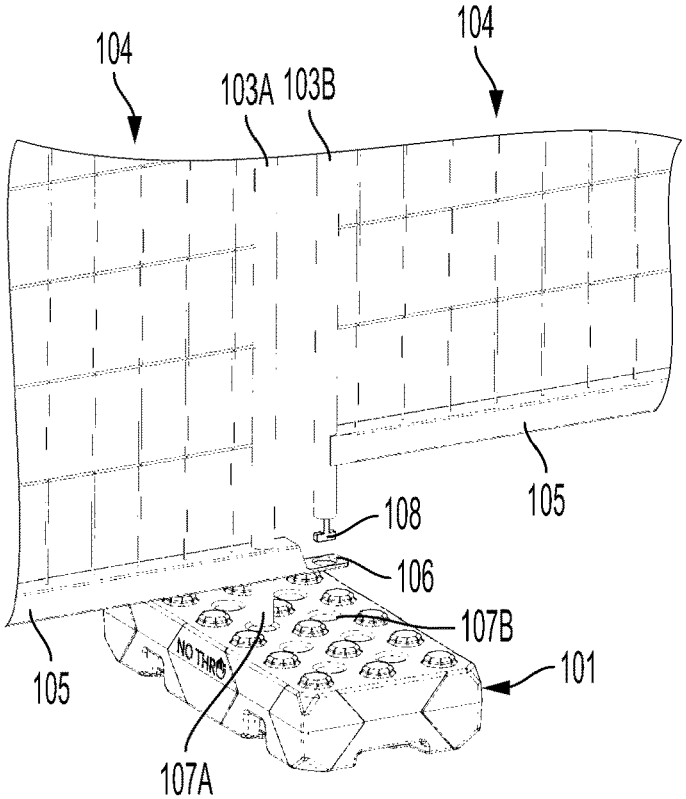
FIGS. 6 and 7 illustrate the steps of interconnecting fence panels to a support foot.
Figure 7:
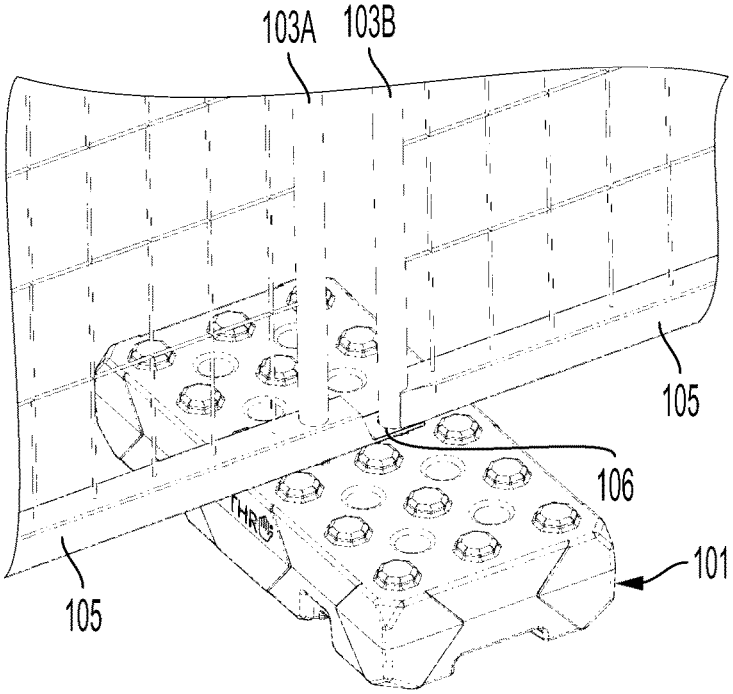

With reference to FIG. 1, temporary barrier fencing 100 comprises support feet 101 which, with reference to FIG. 6, support posts 103 of adjacent fence panels 104.

Each panel 104 may comprise a lower crossbar 105 and each post 103 may extend beyond the crossbar 105 to engage the foot 101.

The panel 104 comprises a post 103 (referred to herein as a bracing post 103A) at one end which comprises a brace 106 which braces a post 103 of an adjacent panel 104 in use.

The panel 104 comprises a post 103 (referred to herein as a locking post 103B) at an opposite end which keys the foot 101 depending on the orientation of the panel 103 with respect to the foot 101.

The panels 104 may be arranged in alignment to form the fencing 101 wherein each foot 101 is engaged by a bracing post 103A and a locking post 103B of adjacent panels 104. In embodiments, at least one panel 104 may comprise a bracing post 103A or a locking post 103B at one end and a normal post and an opposite end.

As shown in FIG. 6, the brace 106 may narrow to a plate which comprise an aperture therethrough through which the locking post 103B inserts. The locking post 103B can rotate within the aperture, such as wherein the aperture is circular and the locking post 103B is similarly cylindrical.

The brace 106 may extend from the lower crossbar 105. In the embodiment shown in FIG. 8, the lower crossbar 105 tapers to form the brace 106. In the embodiment shown in FIG. 19, a plate is welded to an undersurface of the crossbar 105 to form the brace 106. In the embodiment shown in FIG. 8, an angled plate may be welded to an open end of the crossbar 105 (or inserted therein) to form the brace 106.

Figure 8:
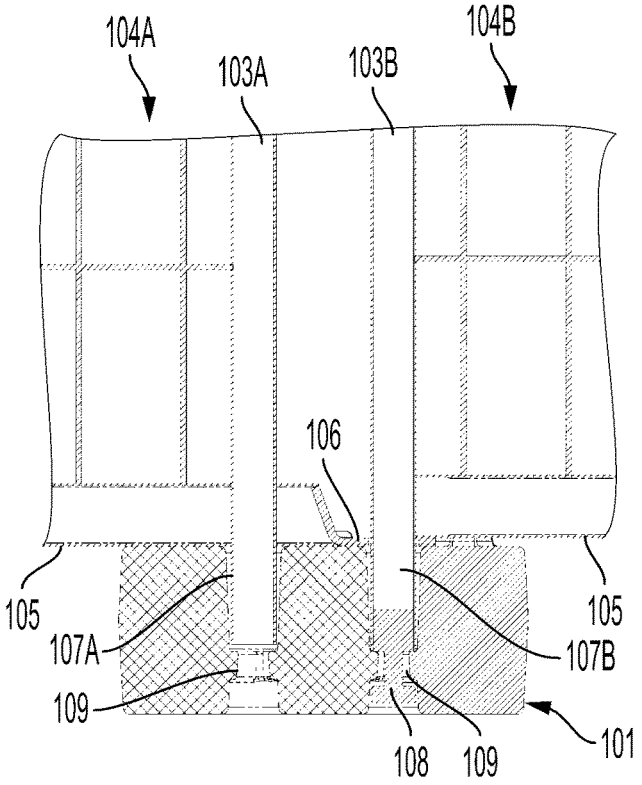
FIG. 8 shows a cross-sectional view illustrating the interconnection of the posts and the support foot of FIG. 7.
Figure 9:
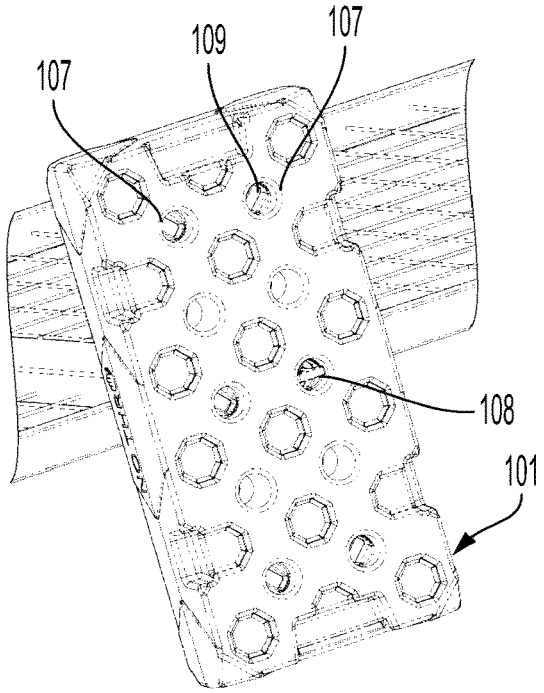
FIG. 9 shows an underside perspective view of the support foot of FIG. 8.

With reference to FIGS. 8 and 9, the foot 101 may comprise a pair of post apertures 107 within which the posts 103 insert adjacently.

With reference to FIG. 6, the bracing post 103A may be inserted into a first aperture 107A wherein the aperture of the brace 106 collocates with a second post aperture 107B. The locking post 103B is then inserted through the aperture of the brace 106 to engage the second post aperture 107B.

Figure 12:
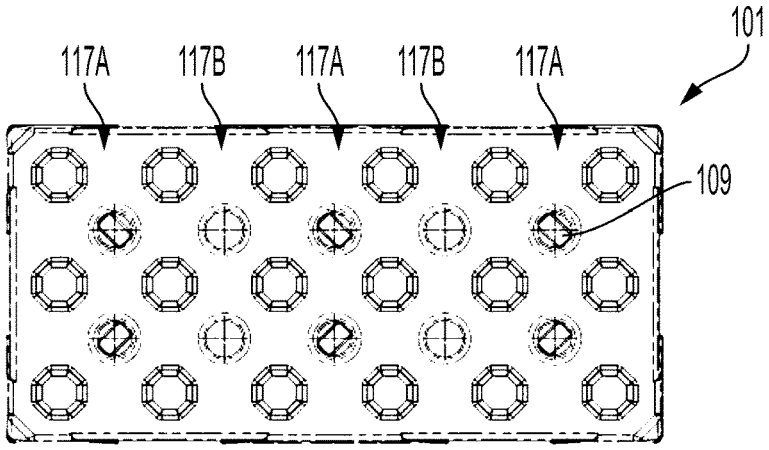
FIG. 12 shows a top plan view of the support foot of FIG. 10.
Figure 13:
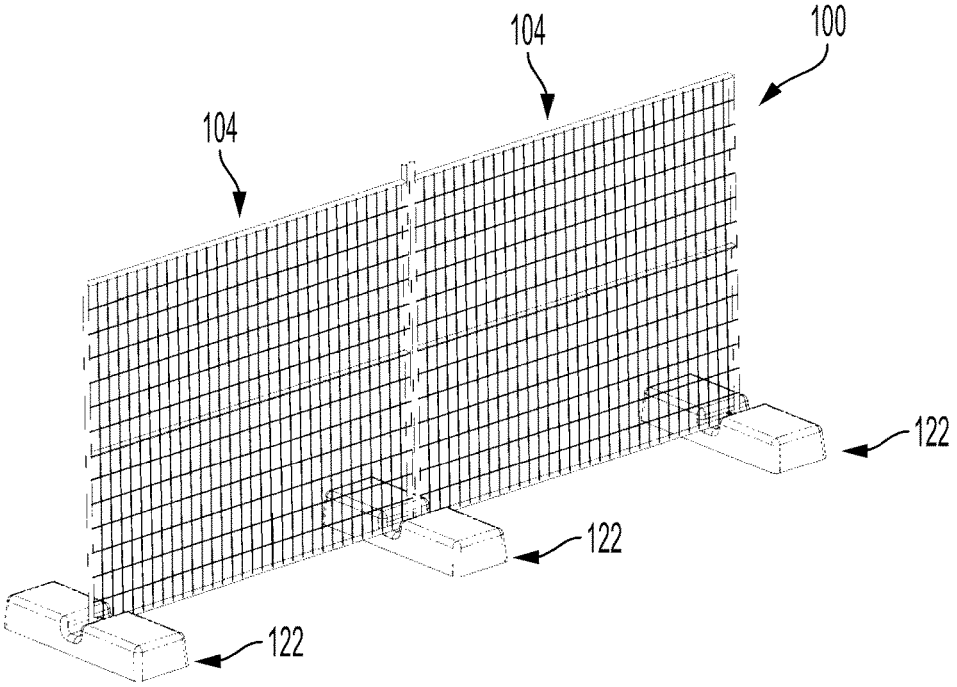
FIG. 13 shows a fencing arrangement comprising foot covers in accordance with an embodiment.

The locking post 103 may define a key 108 which slots into a corresponding keyhole 109 within the aperture 107. The key 108 and the keyhole 109 may be configured such that the key 108 can only insert into the keyhole 109 depending on the orientation of the panel 104 with respect to the foot 101. As shown in FIGS. 9 and 12, the keyholes 109 may be orientated at 45° with respect to an orthogonal axis of the foot 101.

As such, when inserting the locking post 103B into the foot 101 through the brace 106, the panel 104 may be orientated at 45° with respect to the foot 101.

Once the key 108 is inserted through the keyhole 109, the panels 104 are then aligned so that the locking post 103B cannot be pulled from the second aperture 107B.

The brace 106 holds the posts 103 in alignment so that the foot 101 cannot be rotated with respect to the aligned panels 104 to attempt to disengage the locking post 103B.

As is shown in FIG. 8, the keyhole 109 may be recessed a certain depth within the aperture 107 and wherein the key 108 extends further from a distal end of the locking post 103B as compared to the bracing post 103A. As such, the bracing post 103A may freely insert into the first post aperture 107.

It should be appreciated from the configuration of the key 108 and the keyhole 109 that the locking post 103B may also lock to the foot 101 when the panels 104 are orthogonal with respect to each other. In other words, the 45° orientation of the key 108 and the keyhole 109 allows for the arrangement of temporary barrier fencing 100 straight and orthogonally.

In embodiments, the orientations of the keyholes 109 may be configured so that the locking post 104B locks to the foot 101 at 45°.

Figure 4:
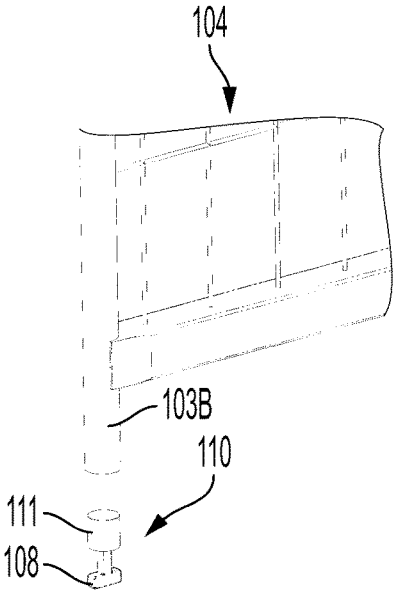
FIG. 4 shows an exploded perspective view of a bottom of a locking post in accordance with an embodiment.

FIG. 4 shows wherein a key piece 110 having the key 108 and comprising a collar 111 which can be retrofitted into an open end of the locking post 103B. The collar 110 may be welded to the locking post 103B in the correct orientation.

Figure 18:
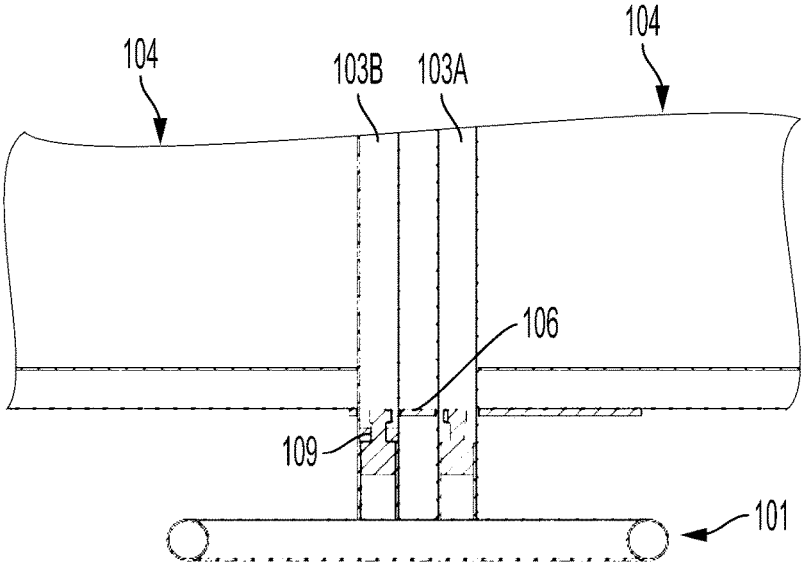
FIG. 18 shows a cross-sectional elevation view of panels engaging the support foot of FIG. 17.
Figure 19:
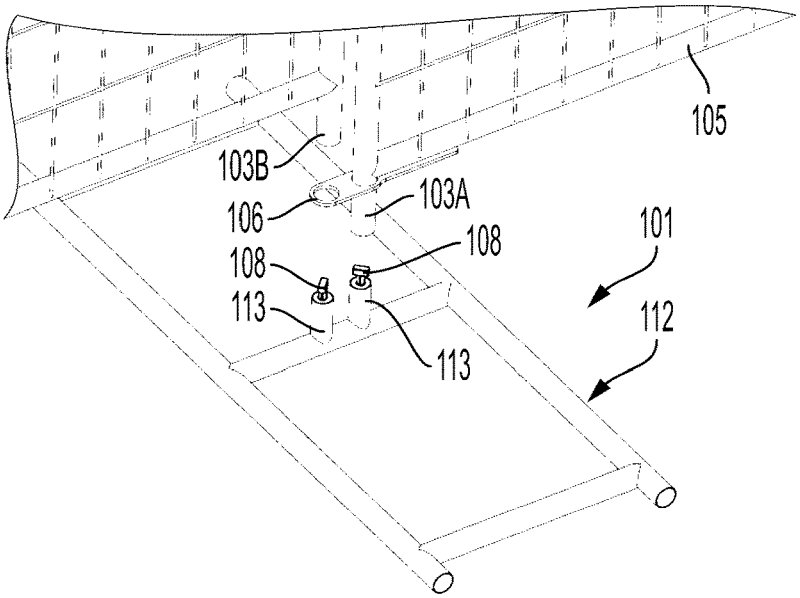
FIG. 19 shows a disassembled perspective view of panels engaging the support foot of FIG. 17.

Whereas the embodiments of FIGS. 6-9 show wherein the foot 101 comprises post apertures 107 into which the posts 103 insert, FIGS. 18 and 19 show an embodiment wherein the foot 101 comprises a base frame 112 supporting a pair of uprights 113 which insert into open ends of the posts 103.

Figure 16:
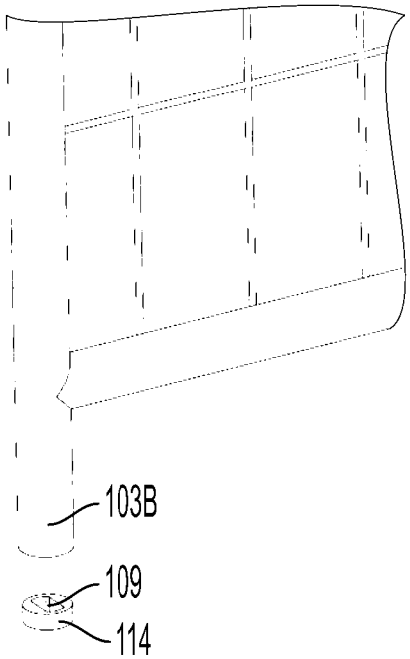
FIG. 16 shows a perspective view of a lower end of a locking post in accordance with a further embodiment.
Figure 17:
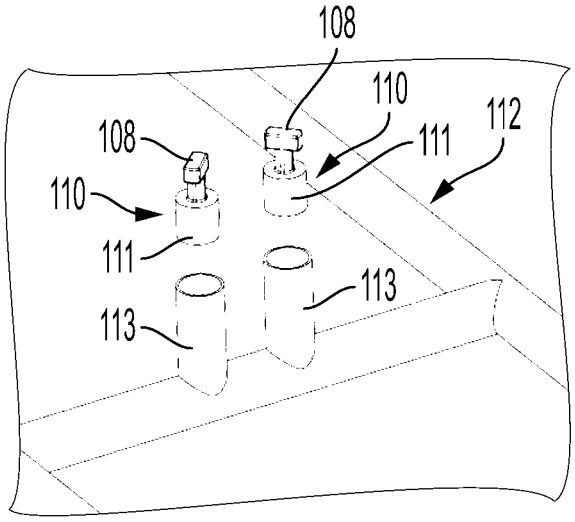
FIG. 17 shows an exploded representation of a frame-type support foot in accordance with an embodiment.

Furthermore, both uprights 113 may comprise a key 108 either of which may slot into the keyhole 109 of the locking post 103B. FIG. 16 shows an insertable collar 114 defining the keyhole 109 which may be retrofitted into an open end of the locking post 103B. FIG. 17 similarly shows wherein the key piece 110 may be retrofitted to the uprights 113.

As shown in FIG. 1, the fencing 100 may comprise upper fence panel retainers 127 which prevent the posts 103 from being prised apart. The retainer 127 may comprise a proximal piece 130, a cross piece 129 and an insertion piece 128.

Figure 3:
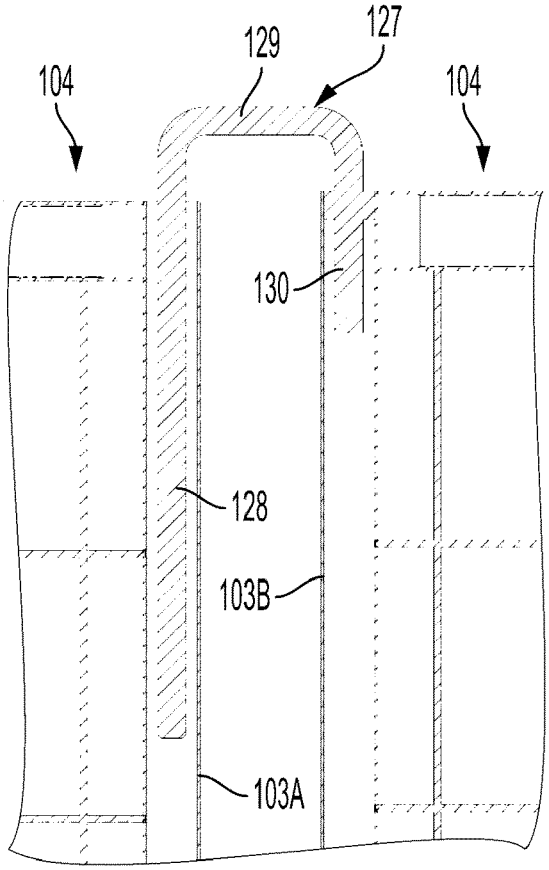
FIG. 3 shows a cross-sectional view of a fence panel retainer in accordance with an embodiment.

With reference to FIG. 3, the proximal piece 130 may be affixed to the locking post 103B and the insertion portion 128 may inserts into the bracing post 103A as the locking post 103B engages the foot 101.

As can be appreciated, when the locking post 103B is locked to the foot 101, the retainer 127 further prevents the bracing post 103A from being lifted from the foot 101 because an upper end of the bracing post 103A hits the cross piece 129.

As is further shown in FIG. 3, the insertion piece 128 may have sufficient length so that a distal end thereof remains within the bracing post 103A as the locking post 103B disengages from the foot 101. In other words, the length of the insertion piece 128 sufficient to prevent disconnection of the retainer 127 whilst the locking post 103 is locked to the foot 101.

Figure 5:
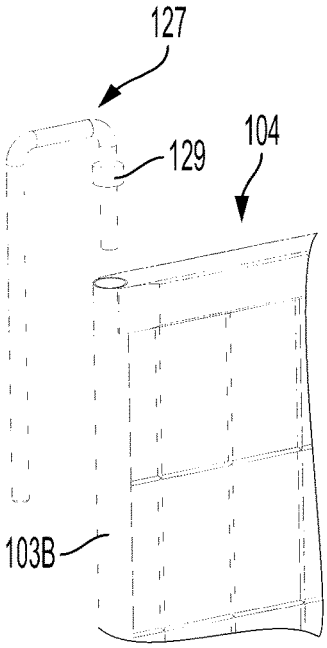
FIG. 5 shows an exploded perspective view of a top of a locking post in accordance with an embodiment.

FIG. 5 illustrates how a retainer piece 127 may be retrofitted to the locking panel 104B which comprises a collar 129 which engages within an opening of the locking post 103B. The collar 129 may be welded to the post 103.

Figure 10:
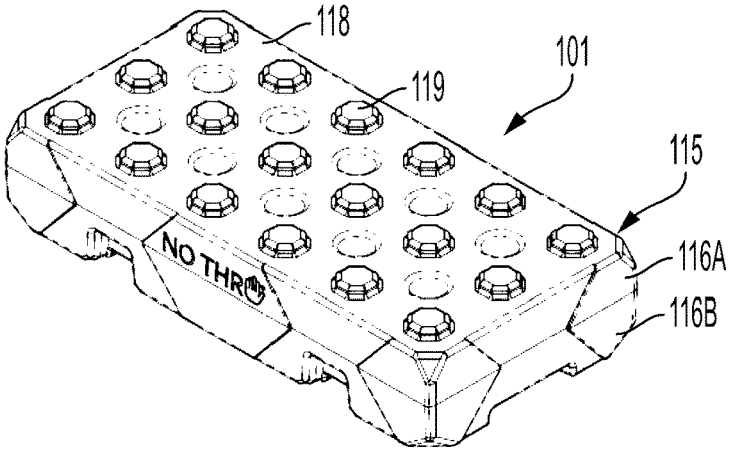
FIG. 10 shows a top perspective view of a support foot in accordance with an embodiment.
Figure 11:
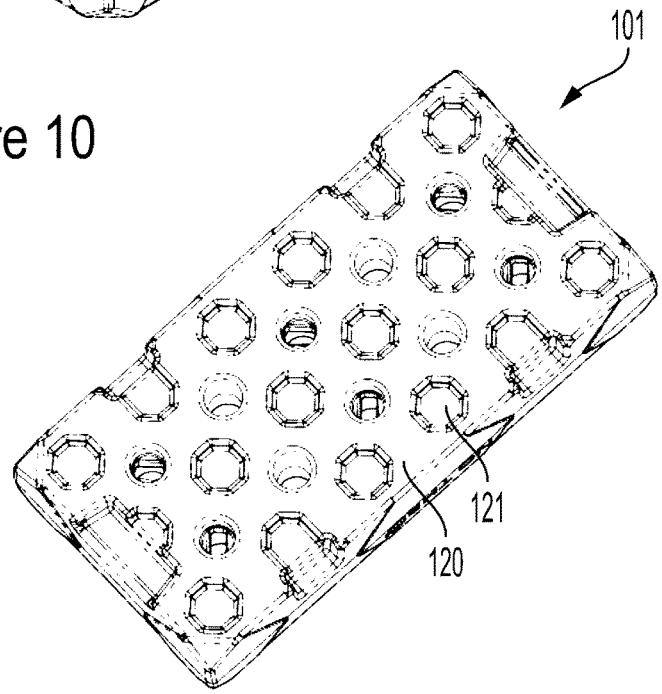
FIG. 11 shows a bottom perspective view of the support foot of FIG. 10.

FIGS. 10-12 show an embodiment wherein the foot 101 comprises a moulded shell 115 which may be filled with ballast such as sand or water. The shell 115 may be formed by an upper shell piece 116A which is connected to a lower shell piece 116B.

The foot 101 may comprise a plurality of pairs 117 of post apertures 107 for engaging the post 103 adjacently therein at different positions. In the embodiment shown, the foot 101 is substantially rectangular and wherein the pairs 117 are arranged along the length thereof. As such, in the manner shown in FIG. 2, a post 103 may engage the foot 101 centrally so that the foot 101 braces the panel 104 equally either side or alternatively from one end for cantilevered support.

As shown in FIG. 12, the pairs of apertures 117 may comprise keyed pairs 117A and non-keyed pairs 117B.

With reference to FIG. 10, an upper surface 118 of the foot 101 may comprise an arrangement of studs 119 extending from the upper surface 118 and, with reference to FIG. 11, a lower surface 120 thereof may comprise a corresponding arrangement of conforming recesses 121.

Figure 2:
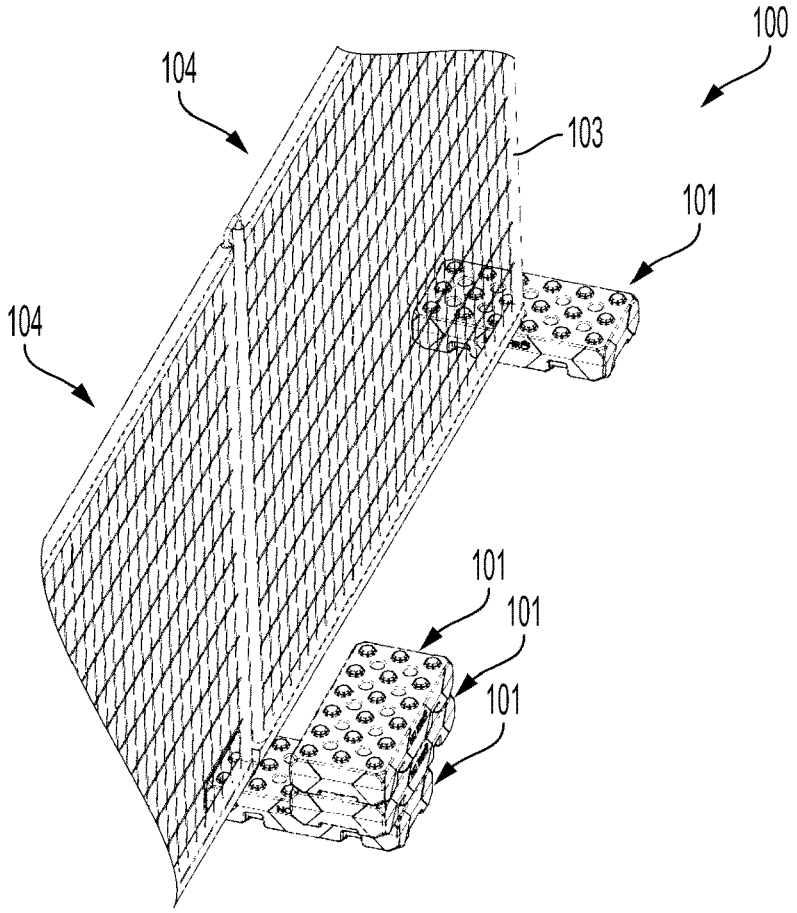

The studs 119 and the recesses 121 allow plastic moulded feed 101 to be stacked in a variety of configurations in the manner shown in FIG. 2. As is shown, the plastic moulded feed 101 may be stacked directly atop each other or alternatively across each other.

The studs 119 and the recesses 121 may be noncircular but which comprise orthogonal symmetry, such as being octagonal, allowing for orthogonal interconnection.

Figure 14:
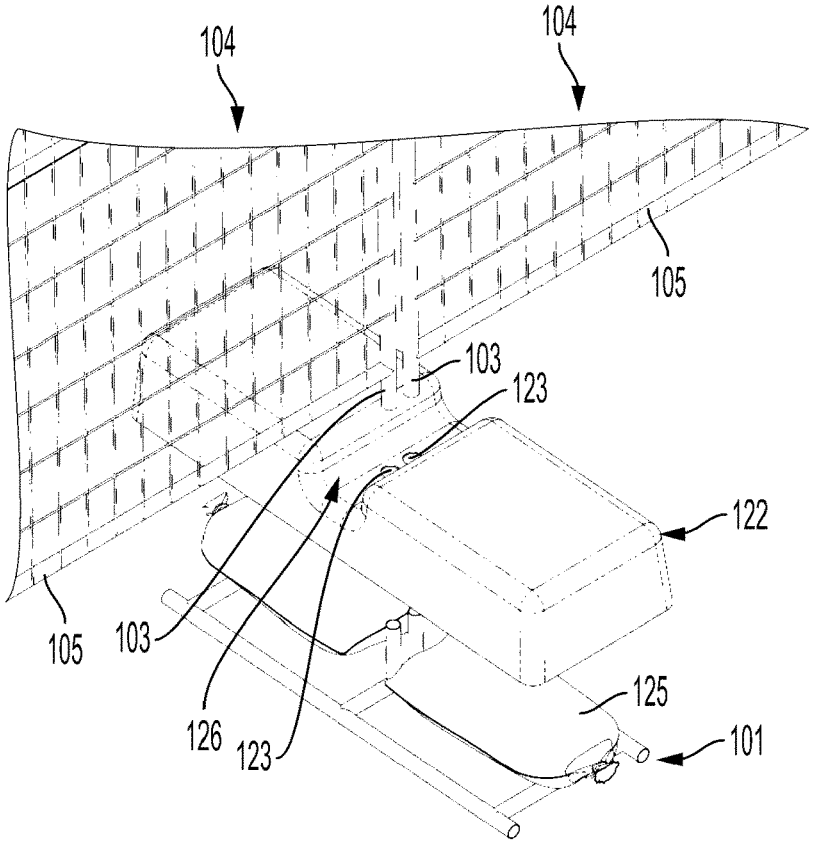
FIG. 14 shows an exploded representation of a foot cover of FIG. 13.

FIG. 14 shows an embodiment comprising a foot cover 122 which covers the foot 101, which is shaped to define a ballast void 124 therein and which cannot be removed from the foot 101 when the locking post 103B is locked to the foot 101.

The cover 122 may be made of moulded plastic. The cover 122 may comprise a pair of post apertures 123 for the posts 103 to engage the foot 101 therethrough.

Figure 15:
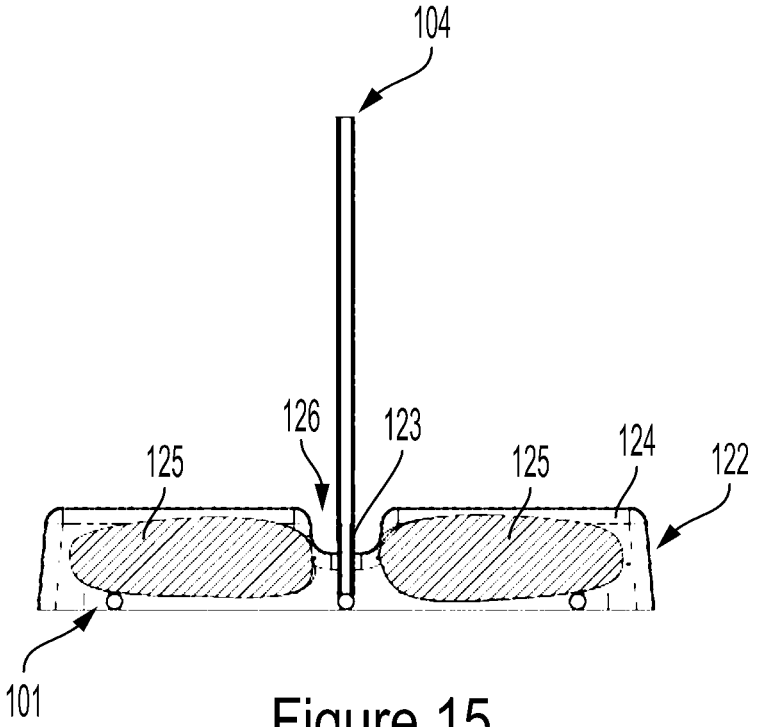
FIG. 15 shows a cross-sectional illustration of a foot cover of FIG. 13.

With reference to FIG. 15, the cover 122 is shaped to define a ballast void 124 suitable for sandbags 125.

The cover 122 cannot be lifted from the foot 101 when the posts 103 are engaged thereto, thereby preventing the unauthorised removal of the ballast.

The cover 122 may be elongate and the apertures 123 may be centrally located so that the cover 122 extends from either side of the panel 104. In this way, the cover 122 may conceal ballast (such as a pair of sandbags 125) on either side of the panel 104.

The cover 122 may entirely conceal the foot 101. In other words, the cover 122 may define a lower edge which has a greater cross-section than that of the foot 101 so that the cover 122 entirely conceal the foot 101 therein in the manner shown in FIG. 15.

The cover 122 may define a saddle 126 thereacross having the apertures 123 therethrough. The saddle 126 presses against the crossbars 105 of the panels 104 to prevent the cover 122 from being lifted from the foot 101 when the posts 103 are locked to the foot 101 yet whilst allowing a sufficient ballast void 124.

In embodiments, the brace 106 may extend approximately 128 mm from an edge of the bracing post 103A. Furthermore, where the brace 106 comprises an aperture therethrough, the aperture may comprise a diameter of approximately 36 mm and allow a distal edge of approximately 10 mm. Where the brace 106 comprises a plate, the plates may be approximately 8 mm thick.

The foregoing description, for purposes of explanation, used specific nomenclature to provide a thorough understanding of the invention. However, it will be apparent to one skilled in the art that specific details are not required in order to practise the invention. Thus, the foregoing descriptions of specific embodiments of the invention are presented for purposes of illustration and description. They are not intended to be exhaustive or to limit the invention to the precise forms disclosed as obviously many modifications and variations are possible in view of the above teachings. The embodiments were chosen and described in order to best explain the principles of the invention and its practical applications, thereby enabling others skilled in the art to best utilize the invention and various embodiments with various modifications as are suited to the particular use contemplated. It is intended that the following claims and their equivalents define the scope of the invention.

The term "approximately" or similar as used herein should be construed as being within 10% of the value stated unless otherwise indicated.

The invention claimed is:

1. Temporary barrier fencing comprising at least one fence panel comprising:

a bracing post which engages a support foot and which comprises a brace which braces an adjacent post in use; and a locking post which keys the foot depending on the orientation of the panel with respect to the foot so that the locking post cannot be pulled from the foot.

2. The fencing as claimed in claim 1, wherein the fencing comprises a plurality of the fencing panels supported by a plurality of support feet therebetween wherein each foot is engaged by a bracing post and a locking post of adjacent panels.

3. The fencing as claimed in claim 1, wherein the brace comprises an aperture through which the locking post inserts and wherein the locking post can rotate within the aperture.

4. The fencing as claimed in claim 1, wherein the brace extends from a horizontal cross bar of the panel.

5. The fencing as claimed in claim 1, wherein the foot comprises a pair of post apertures within which the posts insert.

6. The fencing as claimed in claim 5, wherein the brace comprises an aperture through which the locking post inserts and wherein, when the bracing post is inserted into a first of the pair of post apertures, the aperture of the brace collocates with a second of the pair of post apertures.

7. The fencing as claimed in claim 5, wherein a post aperture and the locking post define a key which slots into a corresponding keyhole depending on the orientation of the panel with respect to the foot.

8. The fencing as claimed in claim 7, wherein the key and the keyhole are aligned at 45° with respect to an orthogonal axis of the foot so that the key inserts into the keyhole when the panel is at 45° with respect to the foot and the locking post locks the foot when being orthogonal with respect to the foot.

9. The fencing as claimed in claim 7, wherein the locking post comprises the key and wherein the aperture comprises the keyhole and wherein the key extends further than a length of the bracing post.

10. The fencing as claimed in claim 1, wherein the foot comprises a base frame supporting a pair of uprights which insert into open ends of the posts.

11. The fencing as claimed in claim 10, wherein each upright comprises a key either of which may slot into a keyhole of the locking post depending on the orientation of the panel with respect to the foot.

12. The fencing as claimed in claim 1, wherein the post of the locking panel comprises an upper retainer which prevents the posts from being prised apart when the locking post is locked to the foot.

13. The fencing as claimed in claim 12, wherein the retainer comprises a proximal piece connected to the locking post, the cross piece and an insertion piece, and wherein the insertion piece inserts into the bracing post as the locking post engages the foot.

14. The fencing as claimed in claim 13, wherein an upper end of the bracing post hits the cross piece if the bracing post is lifted whilst the locking post locks the foot.

15. The fencing as claimed in claim 13, wherein the insertion piece has sufficient length so that a distal end thereof remains within the bracing post as the locking post disengages from the foot.

16. The fencing as claimed in claim 1, wherein the foot comprises a plurality of pairs of post apertures therein for engaging the posts adjacently therein at differing positions.

17. The fencing as claimed in claim 16, wherein the foot comprises a shell defining an interior for ballast.

18. The fencing as claimed in claim 16, wherein the plurality of the pairs of post apertures are arranged along a length of the foot so that the foot can engage the posts centrally or at one end thereof.

19. The fencing as claimed in claim 16, wherein the pairs of post apertures comprise pairs of apertures comprising keyholes and pairs of apertures devoid of keyholes.

20. The fencing as claimed in claim 16, further comprising an arrangement of studs extending from a surface thereof and a corresponding arrangement of conforming recesses on an opposite surface thereof.

21. The fencing as claimed in claim 20, wherein the studs and recesses are arranged so that feet can be stacked orthogonally.

22. The fencing as claimed in claim 21, wherein the studs and recesses are noncircular and comprise orthogonal symmetry.

23. The fencing as claimed in claim 1, further comprising a foot cover which covers the foot, which is shaped to define a ballast void therein and which cannot be removed from the foot when the locking post is locked to the foot.

24. The fencing as claimed in claim 23, wherein the cover is configured to allow the posts to extend therethrough to engage the foot.

25. The fencing as claimed in claim 24, wherein the cover is elongate and engages the posts therethrough at a substantial midpoint of the cover.

26. The fencing as claimed in claim 25, wherein the cover comprises a pair of post apertures for the posts to engage the foot therethrough.

27. The fencing as claimed in claim 23, wherein the cover entirely conceals the foot.

28. The fencing as claimed in claim 23, wherein the cover comprises a saddle thereacross which presses against crossbars of panels engaged to the foot.

29. A method of erecting temporary barrier fencing as claimed in claim 1, the method comprising engaging a bracing post to the support foot and then connecting a locking post to the support foot in a first orientation and then rotating the locking post to a second orientation such that the brace braces the locking post and the locking post keys the foot so that the locking post cannot be pulled from the foot.

* * * * *